United States Patent [19]

Butcher

[11] 4,127,137

[45] Nov. 28, 1978

[54] WASHING APPARATUS

[76] Inventor: Reginald H. Butcher, 4 Summit Dr., Bulleen, Victoria, Australia, 3105

[21] Appl. No.: 740,797

[22] Filed: Nov. 11, 1976

[30] Foreign Application Priority Data

Dec. 11, 1975 [AU] Australia ..... 3916/75

[51] Int. Cl.[2] ..... B08B 3/02; B08B 11/02

[52] U.S. Cl. ..... 134/174; 134/187; 134/198; 195/143; 366/280; 366/273

[58] Field of Search ..... 259/DIG. 46, 22–24; 134/104, 137, 140, 144, 148, 174, 180–181, 187–188, 191, 198; 195/143

[56] References Cited

U.S. PATENT DOCUMENTS

| | | | |
|---|---|---|---|
| 2,116,101 | 5/1938 | Currens | 134/188 |
| 3,036,819 | 5/1962 | Peterson | 259/23 |
| 3,421,528 | 1/1969 | Gomez et al. | 134/188 |
| 3,534,747 | 10/1970 | Hoefer | 134/188 X |
| 3,612,488 | 10/1971 | Bartel et al. | 259/24 X |
| 3,854,704 | 12/1974 | Balas | 259/DIG. 46 X |

*Primary Examiner*—Robert L. Bleutge

*Attorney, Agent, or Firm*—Andrus, Sceales, Starke & Sawall

[57] ABSTRACT

A washing apparatus includes a cuplike casing receiving an annular receptacle containing the articles to be washed. A rotatable fluid distributor radially discharges fluid beneath the receptacle into the cup. The fluid is removed by a central overflow weir.

9 Claims, 4 Drawing Figures

WASHING APPARATUS

BACKGROUND OF THE INVENTION

Field of the Invention

This invention relates to washing apparatus and to gentamicin assay.

In a particular aspect, this invention relates to a washing apparatus suitable for washing paper discs of the type used in certain laboratories for assay purposes.

In another particular aspect, this invention relates to a method of assaying for gentamicin.

Applicant has recently developed a useful procedure for serum gentamicin assay by enzymatic adenylation and in the course of that development has found the need of, and has developed, apparatus for washing paper discs. However, that apparatus may be put to a number of other uses.

SUMMARY OF THE INVENTION

The present invention provides washing apparatus comprising an outer casing, a plurality of cages for receiving and retaining articles to be washed and arranged around a space, washing liquid inlet means located in said space and adapted to direct washing liquid at least generally radially of an imaginary axis and stirrer means located in said space and adapted to rotate about said axis and constructed and arranged to produce a washing liquid motion having components radially of said axis and around said axis.

PREFERRED ASPECTS OF THE INVENTION

In practice, applicant has found that the washing liquid motion usually has components radially outward and inward of said axis and if the stirrer means is arranged to stir through only a part of the depth of liquid the outward and inward components will be located one above the other and when the apparatus is used to wash circular paper discs then those discs usually rotate during washing. This effect can be enhanced if the apparatus has a bottom which slopes downwardly and inwardly as the slope will have a directing effect on liquid flow.

If, as is preferred, the stirrer means includes a number of impeller blades then a circular wave motion around the space seems to be set up which has a generally sinusoidal form and in practice this seems to cause paper discs to bob up and down and, dependent to some extent on the depth of washing liquid, angularly reciprocate back and forth in their cages.

The impeller blades are preferably carried by a body adapted to rotate and that that body has a cavity therein to which washing liquid is delivered and an aperture extending outwardly from that cavity through which washing liquid may be projected radially outwardly. Preferably, only one such aperture is provided as assymetry of flow appears desirable. Further, the generally sinusoidal form referred to above seems to have greater wave length and amplitude than if more than one aperture is used. In this respect, the greater wave length and the greater amplitude appear to produce more positive movement of the paper discs.

The cages are preferably open topped to allow loading of articles thereinto. The cages are preferably joined to one another and may be lifted out of the apparatus as a body.

The outer casing may be provided with an overflow drain and that drain is preferably provided with suction means to positively induce flow.

It is preferred however, that a weir is provided as a drain and that weir is preferably annular with respect to said space. Further, it is preferred that the weir is located relatively inward of the cages so that, in use, the discs are located outwardly of and around the weir. This arrangement of the weir has the advantage that washing liquid can flow outwardly upwardly and then inwardly and over the weir so that used washing liquid tends to be passed over the weir and mixing of fresh and used liquid is minimized. An outwardly located annular weir might be used but is not considered as desirable as a less circular flow of washing liquid is obtained.

An outlet from the outer casing may be provided through the bottom thereof.

The stirrer means preferably comprises a number of magnets and is used in conjunction with a magnetic stirrer outside the outer casing. The stirrer means could, however, be driven positively such as by a shaft.

The preferred form of the apparatus of the present invention establishes different flow patterns at different points within the outer casing but as those flow patterns will cause the discs to move up and down, angularly reciprocate, and rotate, each of the discs and substantially all areas of the discs will be subjected to substantially the same washing conditions.

The apparatus may also be used for washing slides.

The preferred washing apparatus of this invention is useful in gentamicin assay as it is capable of producing consistent and reproducable washing conditions.

A method of gentamicin assay comprises forming an adenylation mixture containing labelled adenosine 5'-triphosphate and an enzyme obtained from E. coli, incubating that mixture and a serum sample, depositing a sample of the incubated mixture on an absorbent disc, washing the disc, drying the disc and determining a measure of the labelled atoms on the disc so obtained to obtain a measure of gentamicin.

A specific construction of washing apparatus in accordance with this invention will now be described with the aid of the accompanying drawings.

DESCRIPTION OF THE VIEW OF THE DRAWINGS

FIG. 1 is a plan view of the apparatus,
FIG. 2 is a cross-section on line 2 — 2 in FIG. 1,
FIG. 3 is a cross-section on line 3 — 3 in FIG. 2, and
FIG. 4 is a detail of part of the apparatus.

DETAILED DESCRIPTION

Figure 1:
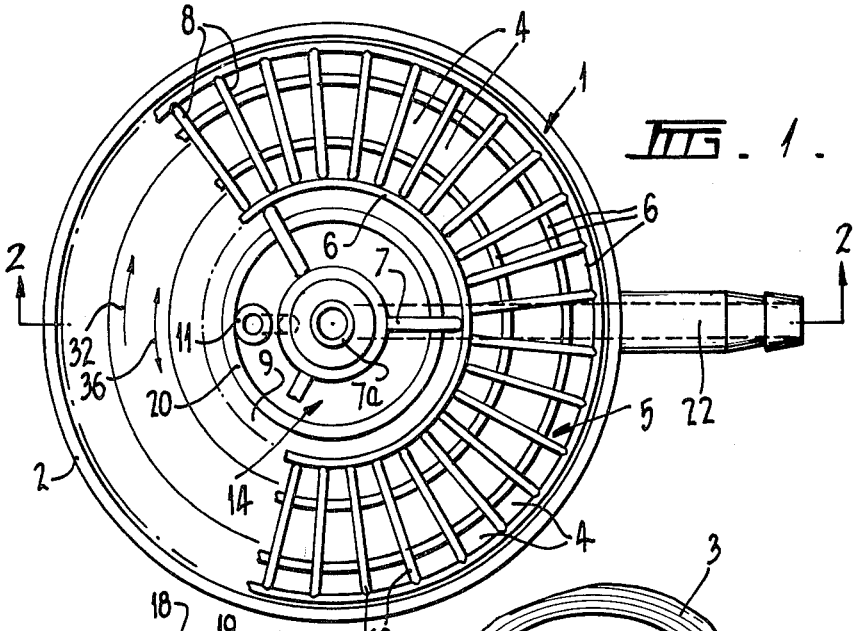
Figure 4:
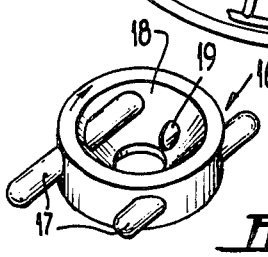
Figure 3:
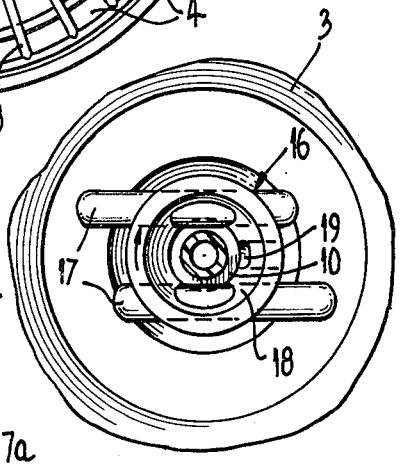

The apparatus shown in the drawings comprises an outer casing 1 which has a cylindrical side wall 2 and a bottom 3. The outer casing is open at the top.

Within the outer casing 1 is an article holding rack 5 made up of cages 4. The rack 5 includes outer, inner and bottom rails 6, radial barriers 8 and a lifting frame 7 provided with a lifting member 7*a*. The barriers may be made of nylon mesh, stainless steel, plastics coated metal or any other suitable material. The cages 4 are closed at their bottoms and radial inner and outer ends by the rails 6 but are open at their tops.

As will be seen from FIG. 1, the cages 4 are arranged as an annulus about a space 9.

Within that space 9 is a boss 10 around which a stirrer 16 is free to rotate. The boss 10 has a threaded projection on which an open ended cylindrical body 14 is screwed. The body 14 is fitted with a tube 11 having an outlet 12 directed downwardly and inwardly.

The stirrer 16 has two horizontally directed magnets 17, a central cavity 18 which registers with the outlet 12 and a single egress aperture 19.

The upper end 20 of the body 14 serves as an overflow weir 20 and an outlet hole 21 in the projection 12 communicates with an outlet tube 22.

In use, the apparatus shown in FIGS. 1–4 is located above a magnetic stirrer (not shown), the tube 11 is connected to a source of washing liquid; for instance, a tap or a flask containing a predetermined volume of washing liquid and provided with a siphon tube connected to tube 11.

A tap operated suction device is connected to the tube 22 or an outlet hose extends to a drain.

Flow from the flask is initiated, the suction device is operated to take off any flow and the magnetic stirrer is operated.

Washing liquid enters via the tube 11, passes into the cavity 18, the stirrer 16 rotates, the magnets 17 stir, washing liquid passes out of the egress aperture 19, passes over the weir 20 and out the outlet tube 22.

Figure 2:
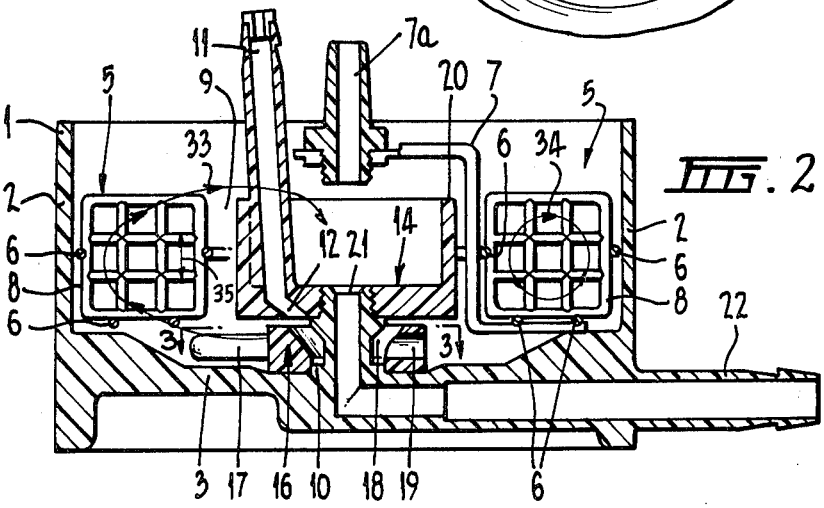

In consequence it has been found that the washing liquid will flow as shown by arrows 33 in FIG. 2 and will cause paper discs in the cages to rotate, as shown by the arrows 34 in FIG. 2 and also has a circular (arrow 32) wave motion which causes paper discs to bob up and down as shown by arrows 35 in FIG. 2 and angularly reciprocate as shown by arrows 36 in FIG. 1.

The above described washing apparatus has been found to give gentle but thorough washing action and has enabled good and quick assays to be produced.

A preferred assay procedure will now be described with the aid of the following Example.

EXAMPLE

The following preparations were made in the manner stated

Adenosine 5'-triphosphate (ATP) mixture

ATP (Unlabelled) Solution

ATP, disodium salt (Sigma A3127, Sigma Chemical Company, Saint Louis, Missouri.) was dissolved in cold distilled water to give a 30 mM solution.

ATP (Labelled) Solution

Adenosine 5'triphosphate, tetra sodium salt (C-$^{14}$C) 40–60 mCi/m mole. NEC 541 (obtained from New England Nuclear, Boston, Massachusetts.).

The labelled and unlabelled ATP solutions were compounded as follows

| | |
|---|---|
| 30 mM A.T.P. Solution in distilled water. | 0.5 ml. |
| $^{14}$C. A.T.P. 54 uCi/ml. (Amersham) | 4.7 ml. |
| Ethanol (AR) absolute | 4.8 ml. |
| Mix and store in the deep freeze. | |
| (N.B. It is liquid at −18° C). | |

to form the ATP mixture.

Broth No. 1

| | |
|---|---|
| Oxoid brain heart infusion broth (Cm 225) | 185 gm. |
| 1M Phosphate buffer (Table 7) | 100 ml. |
| Distilled water | 4900 ml. |
| Sterilised in B.S.L. media sterilizer (or large flask) and cooled to 37° C. | |

Broth No. 2

Broth No. 1 plus gentamicin to a concentration of 10 microg/ml.

1M Phosphate Buffer $KH_2PO_4$ (AR) 27.2 g.
$NaHPO_4$ (AR) 113.6 g.
Distilled water to 1000 ml.
The pH of a 1/20 dilution = 7.4 at 37° C.

TRIS Buffer No. 1

| | |
|---|---|
| TRIS Hydrochloride (Sigma T3253) (tris (hydroxymethyl) aminomethane hydrochloride) | 13.0 g. |
| TRIS Base (Sigma T1503) | 2.30 g. |
| Distilled water to | 100 ml. |

The pH of a 1/20 dilution at 37° C. = 7.26 at 37° C.

TRIS Buffer No. 2

| | |
|---|---|
| TRIS (Sigma T3253) | 8.04 g. |
| TRIS (Sigma T1503) | 5.94 g. |
| Distilled water to | 100 ml. |

The pH of a 1/20 dilution at 37° C. = 7.8

TRIS Buffer No. 3

| | |
|---|---|
| TRIS buffer No. 1 | 10 ml. |
| NaCl (AR) | 1.75 g. |
| Distilled water to | 1000 ml. |
| pH = 7.26 at 37° C. | |

Buffered Sucrose Solution

| | |
|---|---|
| TRIS buffer No. 1 | 30 ml. |
| Tetra sodium EDTA | 1.25 g. |
| Sucrose (AR) | 200 g. |
| Distilled water to | 1 liter. |

1M Magnesium chloride solution

| | |
|---|---|
| $Mg . Cl_2 . 6H_2O$ (AR) | 20.3 g. |
| Distilled water to | 100 ml. |

0.2M Dithiothreitol solution

| | |
|---|---|
| Dithiothreitol (Sigma D0632) | 0.309 g. |
| Distilled water to | 10 ml. |

Store in the deep freeze.

0.5mM Magnesium Chloride solution

| | |
|---|---|
| 1M Magnesium chloride | 0.5 ml. |
| Distilled water | 1000 ml. |

Enzyme preparation

1. Organism. The organism E coli K12 W667/HJR66 is stored in the refrigerator as a stab culture in a nutrient agar deep containing 10ug/ml gentamicin.
2. Innoculum. Subculture the organism to 50 ml of broth No. 2 and incubate 16–18 hours at 37° C.
3. Aseptically add the innoculum to 5000 ml of broth No. 1 at 37° C. in the BSL media sterilizer, which is used as a stirred incubator. Monitor the growth by measuring the optical density at 515nm against the sterile broth No. 1 as a blank. When the growth measures an optical density of 0.7–0.75 (approx 5¼ hours) stop the growth by adding a bucket of crushed ice to the water surrounding the pot containing the culture. Alter the thermostat to cut out the heater.
4. Centrifuge (approx. 5000g for 20 min. i.e., 6000 rpm using angle head of MSE multiplex centrifuge) and carefully decant the supernant (SNF) down the side (prevent splashing) and into a bucket.
5. Resuspend the deposits (use a magnetic stirrer and stir bar) in a total of approx. 1000ml TRIS buffer No. 3.
6. Repeat step 4.
7. Resuspend the deposits in 500 ml of 20% sucrose solution and stand 15–30 minutes at room temperature.
8. Repeat step 4., except centrifuge for 30 minutes and carefully drain and wipe out the shoulders of the centrifuge bottles.
9. Cool the deposits in an ice bath and shock by adding a total of 150 ml of ice cold 0.5mM $MgCl_2$; disperse the deposits quickly with a magnetic stirrer and stir bar.
10. Deep freeze over night with the magnetic stir bars.
11. Thaw in luke warm water (approx. 35° C.) and use the magnetic stirrer to agitate the mixtures, hence speeding the thawing process.
12. Centrifuge, step 4 for a time of 1 hour.
13. Decant the SNF. through an 0.8 micron membrane filter. Several membrane changes may be necessary. The filtrate is further filtered through an 0.45 micron membrane.
14. Store the filtrate (Freeze shock enzyme (FSE) in suitable volumes in the deep freeze.

Enzyme Mixture

| | |
|---|---|
| Enzyme (Freeze shock prepared) | 25 ml |
| 1M TRIS Buffer pH 7.8 37° C | 3 ml |
| 1M Mg . $Cl_2$ | 0.25 ml |
| 0.2M Dithiothreitol | 1.25 ml |

Mix and store in 0.8 ml volumes in the deep freeze. (−18° C.).

Paper Disc wash liquid concentrate

| | |
|---|---|
| $KH_2PO_4$ | 27.2 g. |
| $NaHPO_4$ | 113.6 g. |
| NaCl | 1461 g. |
| Distilled water to 5000 ml. | |

Warm to effect solution and filter through a coarse paper. To prepare the wash liquid for assay, dilute 100 ml. of concentrate to 5000 ml of distilled water.

Gentamicin assay standards

Gentamicin sulphate reference powder (Roussel Pharmaceuticals, Sydney, Australia) was used to prepare the routine assay standards 1, 6, and 12 ug/ml for the adenylation method. Antibiotic free, pooled human serum was used as diluent.

Composition of adenylation mixture

| | |
|---|---|
| Concentrated enzyme | 10.0 ml. |
| 1M TRIS buffer (pH 7.8, 37° C) | 0.5 ml |
| 1M Magnesium chloride | 0.1 ml. |
| 0.2M Dithiothreitol | 0.5 ml. |
| 30 mM ATP | 0.1 ml. |
| 250 uCi/ml ATP $^{14}C$ | 0.1 ml. |

Gentamicin adenylation assay procedure

The adenylation mixture was stored frozen (−18° C.) in two parts: the A.T.P. mixture and the Enzyme mixture. For assay, the adenylation mixture is prepared by thawing the required amount of enzyme mixture and adding 10% A.T.P. mixture. (i.e., for 0.8 ml of enzyme mixture, add 0.08 ml of A.T.P. mixture). Store the adenylation mixture in an ice bath until used.

40 ul of cold adenylation mixture is added with mixing to 20 ul of patient's or standard serum in 'V' bottomed plastic tubes held in an ice bath. All tubes are incubated at 37° C. for 15 minutes and then returned to the ice bath. From each tube, a 50 ul subsample is pipetted onto a 2.5 cm phospho-cellulose paper disc (Whatman P81) Each paper disc is allowed to dry at room temperature until 2 other tubes have been subsampled. The disc is then transferred to the paper disc washer containing wash liquid; subsequent discs are transferred in sequence to the washer after the next tube has been subsampled. This procedure is followed to ensure that all subsamples on the paper have similar adsorbtion and air drying times.

When all the discs have been transferred, the washer is placed on a magnetic stirrer; the wash liquid outlet and wash liquid inlet tubes connected and washing commenced.

The wash liquid consist of 5 liters of a 4 mM phosphate buffer containing 0.1M NaCl and flows into the washer over an approximate period of 6 minutes.

On completion of washing, the paper discs are laid out on clean filter paper to absorb excess liquid before drying in a hot air oven. Each disc is then counted in 10 ml of toluene scintillant for 1 minute after an equilibration time of 5 minutes in an automatic liquid scintillation counter (Unilux 1, Nuclear-Chicago, Des Plaines, Illinois). As the labelled adenylated gentamicin is firmly bound to P81 paper, the scintillant is harvested, filtered and re-used.

Typical assay times are set out below.

| | | TIME |
|---|---|---|
| 1. | PIPETTING<br>0.02 ml standard or patient serum<br>0.04 ml adenylation mixture<br>*ice bath* | 7.5 |
| 2. | INCUBATION 37° C. | 15 |
| 3. | RETURN TO ICE BATH AND SUBSAMPLE<br>0.05 ml to paper. | 4.5 |
| 4. | WASH | 8 |
| 5. | DRY 110° C | 10 |
| 6. | COUNT | 15 |

-continued

| | TIME |
|---|---|
| Total time (minutes) | 60 |

These times are for a total of 9 tubes, i.e., patient's serum and three standard sera all tested in duplicate, plus a pooled human serum control.

The whole procedure takes 1 hour.

For each additional serum tested a further 4 minutes is required. Thus an assay of 8 test sera plus standards can be completed in 1½ hours.

The ratio gentamicin/counts per minute showed a substantially linear relation in the range 0–16 ug/ml and results were reproducable to within ± 6%.

Modifications and adaptions may be made to the above described without departing from the spirit and scope of this invention which includes every novel feature and combination of features disclosed herein.

The claims form part of the disclosure of this specification.

I claim:

1. Washing apparatus suitable for use with a rotary power source comprising:

a cuplike casing having a central axis;

an annular receptacle for receiving and retaining articles to be washed, said receptacle comprising a plurality of circumferentially positioned cages, said receptacle being removably received within said cuplike casing at a predetermined position along the axis of said casing;

a fluid distributing means mounted along the axis of said casing below said annular receptacle and within the central opening thereof, said fluid distributing means being rotatable by said rotary power source, said fluid distributing means having a central plenum for receiving fluid and a port connected to said plenum for discharging said fluid in a direction radial of said axis into said casing;

inlet means for providing fluid to said central plenum; and overflow means operatively associated with said casing for controlling the fluid level therein in accordance with the axial position of said annular receptacle and for discharging fluid therefrom.

2. The washing apparatus according to claim 1 wherein said fluid distributing means includes stirrer means for said fluid.

3. Washing apparatus as claimed in claim 2, wherein the fluid distributing means includes a number of impeller blades.

4. The washing apparatus according to claim 1 wherein said fluid distributing means with said fluid discharge port is so positioned with respect to said overflow means as to provide a fluid circulation within said casing having vertically spaced flow components flowing in opposite radial directions.

5. Washing apparatus as claimed in claim 4, wherein the inside botton of the outer casing slopes downwardly and inwardly.

6. The washing apparatus according to claim 4 wherein said fluid distributing means is located along the bottom of said casing and wherein said overflow means is centrally located in said casing above said fluid distributing means.

7. The washing apparatus according to claim 1 wherein said fluid distributing means has a single discharge port.

8. The washing apparatus according to claim 1 wherein said fluid distributing means includes a plurality of discharge ports positioned on said fluid distributing means for asymmetric discharge of the fluid.

9. The washing apparatus according to claim 1 wherein said overflow means comprises a level controlling weir located within the central opening of said annular receptacle.

* * * * *